US010457438B2

(12) United States Patent
Bates et al.

(10) Patent No.: US 10,457,438 B2
(45) Date of Patent: Oct. 29, 2019

(54) MULTI-FUNCTIONAL CONTAINER BASE

(71) Applicant: Amcor Rigid Plastics USA, LLC, Wilmington, DE (US)

(72) Inventors: Peter A. Bates, Sylvania, OH (US); Ronald McFarlane, Sylvania, OH (US)

(73) Assignee: AMCOR RIGID PLASTICS USA, LLC, Wilmington, DE (US)

( * ) Notice: Subject to any disclaimer, the term of this patent is extended or adjusted under 35 U.S.C. 154(b) by 133 days.

(21) Appl. No.: 15/517,073

(22) PCT Filed: Oct. 17, 2014

(86) PCT No.: PCT/US2014/061096

§ 371 (c)(1),
(2) Date: Apr. 5, 2017

(87) PCT Pub. No.: WO2016/060680

PCT Pub. Date: Apr. 21, 2016

(65) Prior Publication Data

US 2017/0297759 A1 Oct. 19, 2017

(51) Int. Cl.
*B65D 1/02* (2006.01)
*B65D 21/02* (2006.01)
(Continued)

(52) U.S. Cl.
CPC ..... *B65D 1/0276* (2013.01); *B65D 1/0215* (2013.01); *B65D 1/0246* (2013.01);
(Continued)

(58) Field of Classification Search
CPC .... B65D 79/005; B65D 79/00; B65D 1/0246; B65D 1/023; B65D 1/0276; B65D 1/0261;
(Continued)

(56) References Cited

U.S. PATENT DOCUMENTS 3,217,915 A * 11/1965 Weygandt ..... B65D 21/0231 215/10
4,747,497 A * 5/1988 Holman ..... B65D 79/005 215/230
(Continued)

FOREIGN PATENT DOCUMENTS

DE 19924827 A1 10/2000
FR 2991972 A1 12/2013
(Continued)

OTHER PUBLICATIONS

International Search Report and Written Opinion for PCT/US2014/061096, dated Jul. 13, 2015; ISA/KR.
(Continued)

*Primary Examiner* — Robert J Hicks
(74) *Attorney, Agent, or Firm* — Harness, Dickey & Pierce, P.L.C.

(57) ABSTRACT

A container includes a finish, a shoulder portion, a body, and a base portion. The finish defines an opening. The shoulder portion extends from the finish. The body extends from the shoulder portion and defines a chamber. The base portion extends at an end of the body opposite to the shoulder portion and is moveable from an as-blown position to an expanded position and from the expanded position to a retracted position. The base portion includes a standing ring, a pivot area, and a central area. The pivot area is disposed between the standing ring and the central area. The pivot area is configured to flex and move the central area along the longitudinal axis when the base portion moves from the as-blown position to the expanded position, and from the expanded position to a retracted position.

18 Claims, 9 Drawing Sheets

(51) Int. Cl.
*B65D 41/04* (2006.01)
*B65D 79/00* (2006.01)

(52) U.S. Cl.
CPC ..... *B65D 21/0231* (2013.01); *B65D 41/04* (2013.01); *B65D 79/005* (2013.01)

(58) Field of Classification Search
CPC ..... B65D 1/0215; B65D 41/04; B65D 41/06; B65D 21/0231; B65D 21/023; B65D 21/0202; B65D 21/0201; B65D 21/0217
USPC ..... 220/629, 628, 609, 608, 604, 600, 624, 220/623, 610, 293, 288, 380; 215/373, 215/372, 371, 376, 900, 329, 316, 370; 206/507, 505, 504, 508; 428/36.9; D9/548, 520, 516
See application file for complete search history.

(56) References Cited

U.S. PATENT DOCUMENTS

| | | | | |
|---|---|---|---|---|
| 6,632,493 | B1 * | 10/2003 | Hildebrand, IV | B65D 1/0215 222/206 |
| 9,834,359 | B2 * | 12/2017 | Bates | B65D 21/0231 |
| 9,994,378 | B2 * | 6/2018 | Wurster | B65D 1/0276 |
| 2002/0148805 | A1 * | 10/2002 | Wurster | B29C 49/48 215/374 |
| 2004/0121097 | A1 * | 6/2004 | Nahill | B29C 49/42 428/35.7 |
| 2005/0139569 | A1 * | 6/2005 | Larsen | B29C 49/0073 215/44 |
| 2006/0138074 | A1 | 6/2006 | Melrose | |
| 2007/0084821 | A1 | 4/2007 | Bysick et al. | |
| 2007/0215571 | A1 | 9/2007 | Trude | |
| 2010/0163513 | A1 | 7/2010 | Pedmo | |
| 2012/0255927 | A1 | 10/2012 | Cook | |
| 2013/0001235 | A1 | 1/2013 | Patcheak et al. | |
| 2013/0213980 | A1 | 8/2013 | Pedmo et al. | |

FOREIGN PATENT DOCUMENTS

| | | | |
|---|---|---|---|
| JP | 200229552 | A | 1/2002 |
| JP | 2008100729 | A | 5/2008 |
| JP | 2008539141 | A | 11/2008 |
| JP | 2009524562 | A | 7/2009 |
| JP | 2010275014 | A | 12/2010 |
| JP | 2012513943 | A | 6/2012 |
| JP | 2012158339 | A | 8/2012 |
| JP | 2013144560 | A | 7/2013 |
| JP | 2013154907 | A | 8/2013 |
| JP | 2014125236 | A | 7/2014 |
| WO | 2013073261 | A1 | 5/2013 |
| WO | WO-2014036516 | A1 | 3/2014 |

OTHER PUBLICATIONS

Supplementary European Search Report issued in corresponding European Patent Application No. 14904005.7 dated Mar. 14, 2018.
Japanese Office Action dated Nov. 6, 2018 in corresponding Japanese Patent Application No. 2017-519678.

* cited by examiner

MULTI-FUNCTIONAL CONTAINER BASE

CROSS-REFERENCE TO RELATED APPLICATION

This application is a U.S. National Phase Application under 35 U.S.C. 371 of International Application No. PCT/US2014/061096 filed on Oct. 17, 2014 and published as WO 2016/060680 A1 on Apr. 21, 2016. The entire disclosure of the above application is incorporated herein by reference.

FIELD

The present disclosure relates to a base for a container.

BACKGROUND

This section provides background information related to the present disclosure which is not necessarily prior art.

As a result of environmental and other concerns, plastic containers, more specifically polyester and even more specifically polyethylene terephthalate (PET) containers, are now being used more than ever to package numerous commodities previously packaged in glass containers. Manufacturers and fillers, as well as consumers, have recognized that PET containers are lightweight, inexpensive, recyclable and manufacturable in large quantities.

PET is a crystallizable polymer, meaning that it is available in an amorphous form or a semi-crystalline form. The ability of a PET container to maintain its material integrity relates to the percentage of the PET container in crystalline form, also known as the "crystallinity" of the PET container. The following equation defines the percentage of crystallinity as a volume fraction:

$$\%\ \text{Crystallinity} = \frac{\rho - \rho_\alpha}{\rho_c - \rho_\alpha} \times 100$$

where $\rho$ is the density of the PET material; $\rho_a$ is the density of pure amorphous PET material (1.333 g/cc); and $\rho_c$ is the density of pure crystalline material (1.455 g/cc).

Manufacturers currently supply PET containers for various liquid commodities, such as juice and isotonic beverages. Suppliers often fill these liquid products into the containers while the liquid product is at an elevated temperature, typically between 68° C.-96° C. (155° F.-205° F.) and usually at approximately 85° C. (185° F.).

After being hot-filled, the heat-set containers are capped and allowed to reside at generally the filling temperature for up to five (5) minutes at which point the container, along with the product, is then actively cooled prior to transferring to labeling, packaging, and shipping operations. The cooling reduces the volume of the liquid in the container. This product shrinkage phenomenon results in the creation of a vacuum within the container. Generally, vacuum pressures generated within the container can be up to 24 in Hg. If not controlled or otherwise accommodated, these vacuum pressures result in deformation of the container, which leads to either an aesthetically unacceptable container or one that is unstable.

SUMMARY

This section provides a general summary of the disclosure, and is not a comprehensive disclosure of its full scope or all of its features.

The present disclosure provides for a container including a finish, a shoulder portion, a body, and a base portion. The finish defines an opening. The shoulder portion extends from the finish. The body extends from the shoulder portion in a direction parallel with a longitudinal axis and defines a chamber. The base portion extends at an end of the body opposite to the shoulder portion and may be moveable from an as-blown position to an expanded position and from the expanded position to a retracted position. The base portion includes a standing ring, a pivot area, and a central area. The pivot area is disposed between the standing ring and the central area. The pivot area flexes and moves the central area along the longitudinal axis when the base portion moves from the as-blown position to the expanded position, and from the expanded position to the retracted position.

The present disclosure further provides for a container including a finish, a shoulder portion, a body, and a base portion. The finish defines an opening. The shoulder portion extends from the finish. The body extends from the shoulder portion in a direction parallel with a longitudinal axis and defines a chamber. The base portion extends at an end of the body opposite to the shoulder portion and may be moveable from an as-blown position to an expanded position and from the expanded position to a retracted position. The base portion includes a planar ring, a planar portion, and a pushup portion. The planar ring is pivotable and moves the planar portion and the pushup portion along the longitudinal axis when the base portion moves from the as-blown position to the expanded position and from the expanded position to the retracted position.

The present disclosure also provides for a container including a finish, a shoulder portion, a body, and a base portion. The finish defines an opening. The shoulder portion extends from the finish. The body extends from the shoulder portion in a direction parallel with a longitudinal axis and defines a chamber. The base portion extends at an end of the body opposite to the shoulder portion and may be moveable from an as-blown position to an expanded position and from the expanded position to a retracted position. The base portion includes a planar ring, a planar portion, and a pushup portion. The base portion defines a plurality of radial grooves along the planar portion and includes a plurality of ribs extending radially in the pushup portion. The ribs are disposed offset and alternative of the radial grooves. The planar ring is pivotable and moves the planar portion and the pushup portion as a uniform section in a first direction along the longitudinal axis as the base portion moves from the as-blown position to the expanded position and in a second direction opposite the first direction as the base portion moves from the expanded position to a retracted position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

The present disclosure will now be described with reference to the accompanying drawings.

Figure 1:
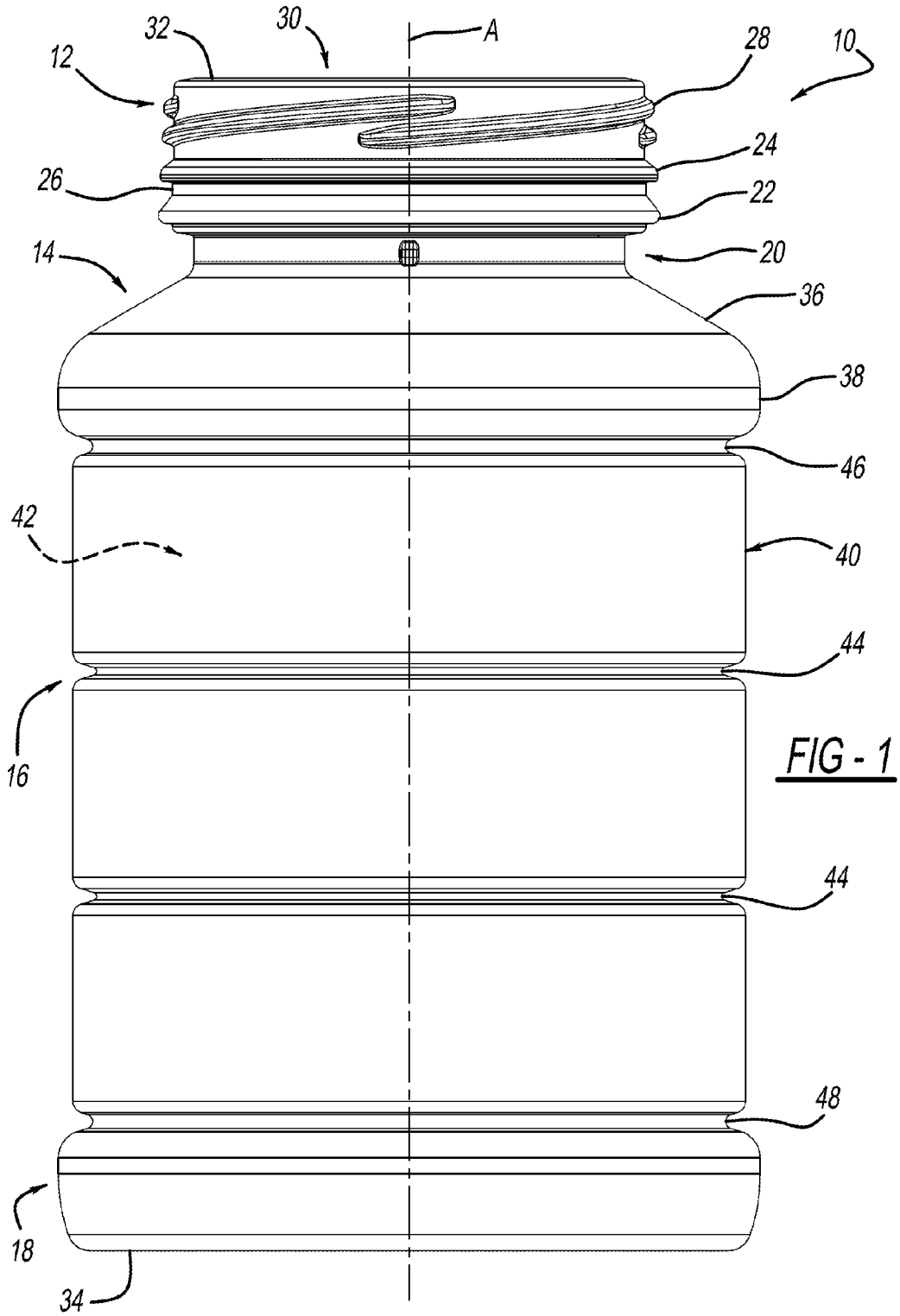
FIG. 1 is a side view of a container according to the present disclosure.
Figure 2:
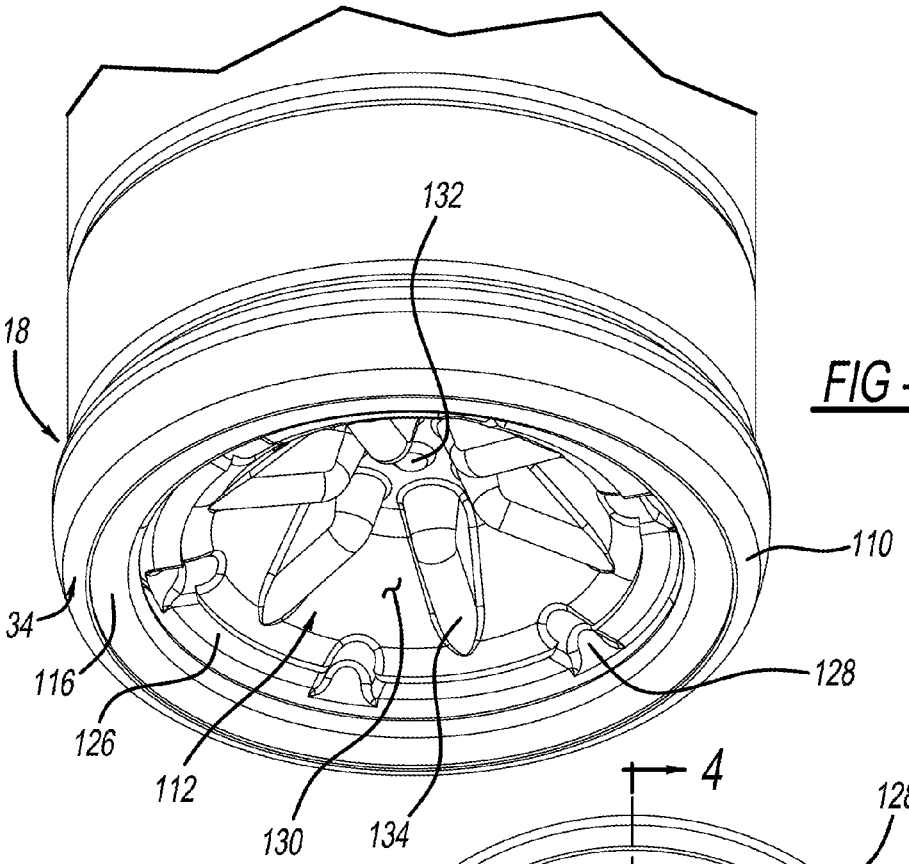
FIG. 2 is a perspective view of a base portion of the container of FIG. 1.
Figure 3:
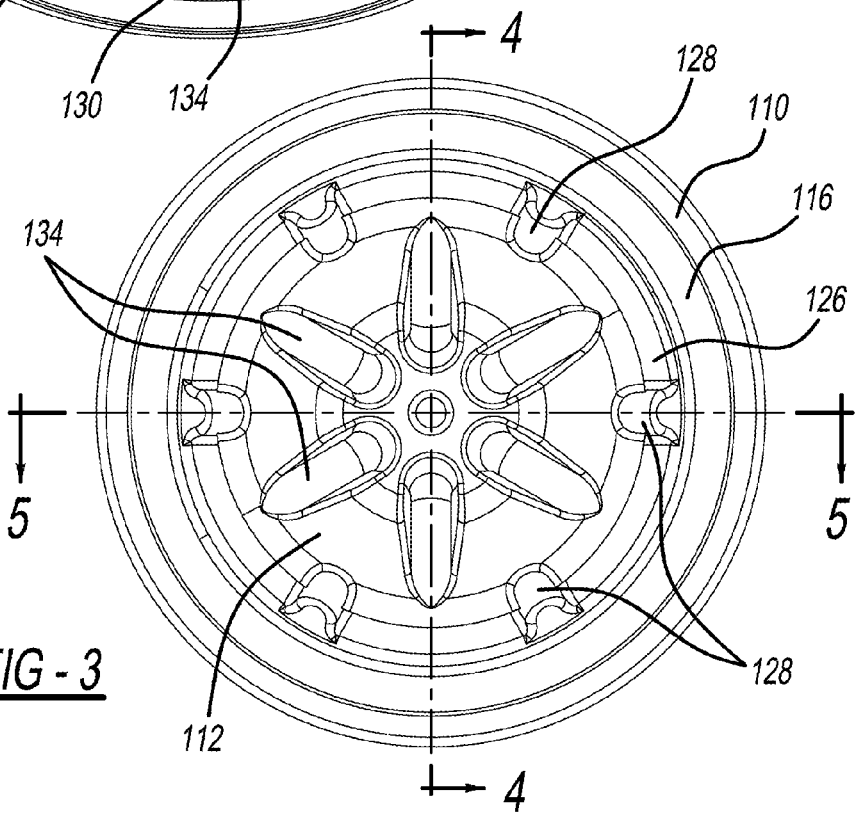
FIG. 3 is a bottom view of the base portion of the container of FIG. 1.

With reference to FIG. 1, a container according to the present disclosure is generally illustrated at reference numeral 10. The container 10 can be any suitable container, such as a blow-molded, biaxially oriented container with a unitary construction made from a single- or multi-layer material. The material can be PET or any other thermoplastic suitable for blow molding. The container 10 generally includes a finish 12, a shoulder portion 14, a body portion 16, and a base portion 18. Features of the container 10 may be described with reference to a longitudinal axis A of the container 10.

The finish 12 extends from a neck 20 and includes a first annular rib 22 and a second annular rib 24. The first annular rib 22 is between the second annular rib 24 and the neck 20. The first annular rib 22 and the second annular rib 24 extend outward beyond an annular sidewall 26 of the finish 12.

The finish 12 further includes threads 28 which extend outward from the annular sidewall 26. Alternatively, the threads may be internal threads that extend from an inner surface of the annular sidewall 26 toward the inside of the container 10. The threads 28 are configured to cooperate with, for example, a metal lug or any other suitable closure, in order to close the container 10 by covering an opening 30 defined by the finish 12. The annular sidewall 26 extends to an upper end 32 of the container 10 at which the opening 30 is defined. The upper end 32 is opposite to a base end 34 of the container 10 at the base portion 18. The finish 12 can be any suitable finish, such as a wide-mouth blow trim finish of any suitable size (e.g., 43 mm or greater), or an injected finish smaller than 43 mm. The finish can also be crystallized by heat and have a white appearance.

The shoulder portion 14 extends from the neck 20 at a side opposite to the first annular rib 22. The shoulder portion 14 includes a tapered surface 36 and an outer diameter portion 38. The outer diameter portion 38 extends from the tapered surface 36 toward the body portion 16. The tapered surface 36 has a progressively larger diameter as it extends from the neck 20 to the outer diameter portion 38.

The body portion 16 extends from the outer diameter portion 38 of the shoulder portion 14. The body portion 16 includes a sidewall 40 which is generally cylindrical and defines a chamber 42. The sidewall 40 may include one or more annular grooves 44. Between the body portion 16 and the shoulder portion 14 is a first recessed ring 46. Between the body portion 16 and the base portion 18 is a second recessed ring 48.

With continued reference to FIG. 1 and additional reference to FIGS. 2-5, the base portion 18 will now be described in detail. The base portion 18 generally includes a standing ring 110 and a pushup portion 112. The standing ring 110 is at an outer diameter of the base portion 18 and forms the base end 34.

Figure 4:
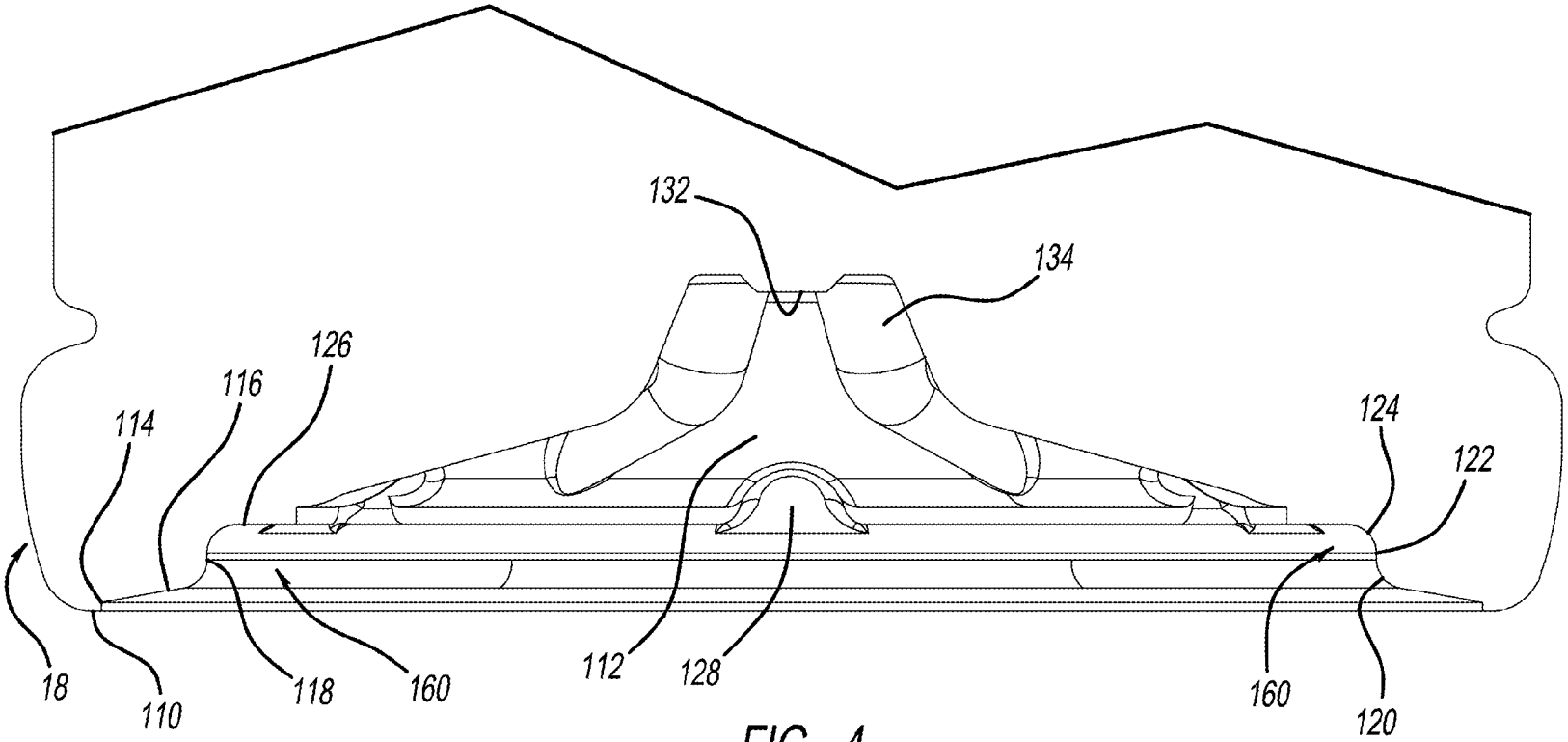
FIG. 4 is a cross-sectional view of the base portion taken along line 4-4 of FIG. 3.

Extending from the standing ring 110, toward the pushup portion 112 is a hinge portion 114 and a planar ring 116. The hinge portion 114 is concave to a surface of the base portion 18 (FIG. 4). The planar ring 116 is configured to move via the hinge portion 114. That is, when the hinge portion 114 flexes, the planar ring 116 pivots at an end extending from the hinge portion 114 as described herein.

Figure 5:
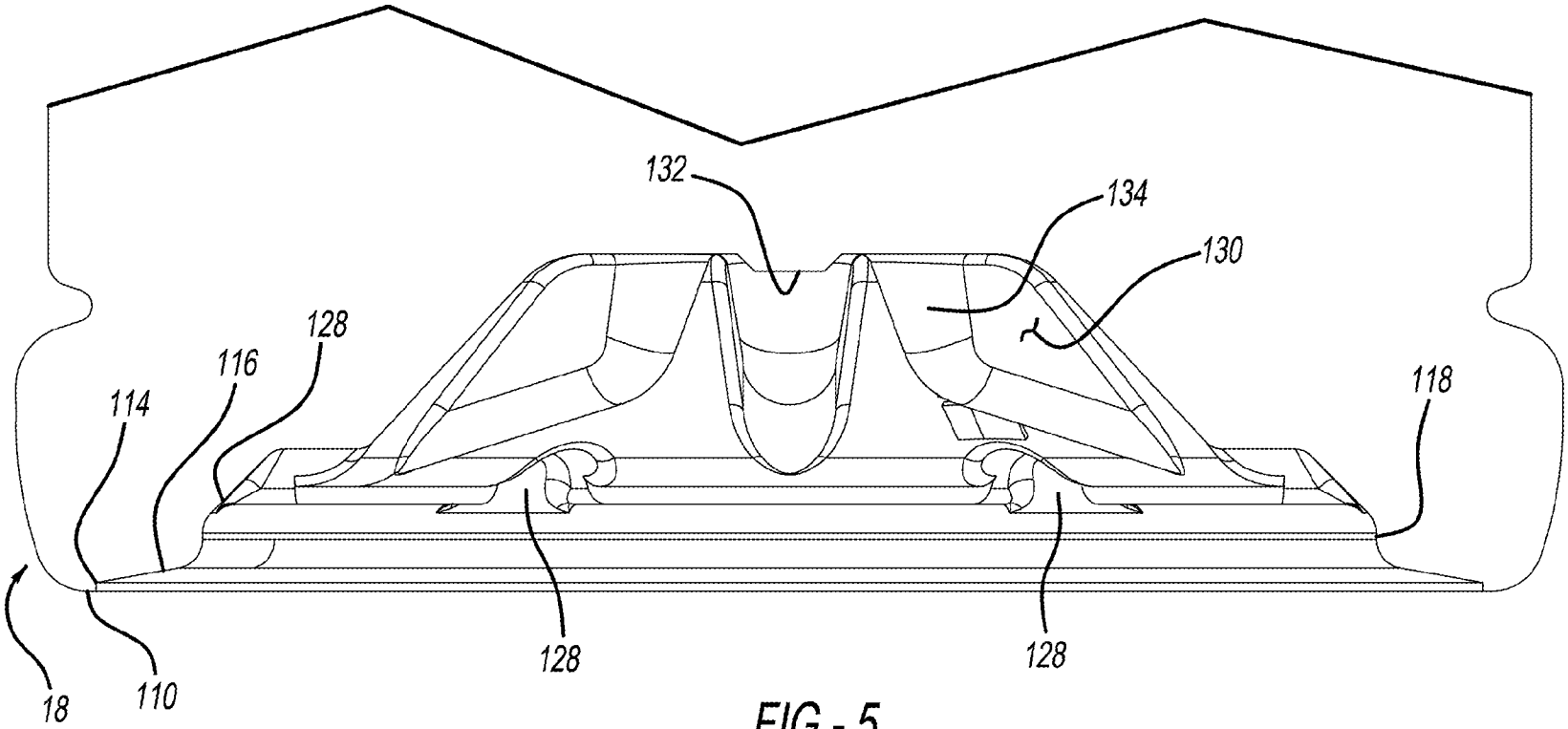
FIG. 5 is a cross-sectional view of the base portion taken along line 5-5 of FIG. 3.

A step 118 extends from the planar ring 116 toward the pushup portion 112 (FIGS. 4 and 5). The step 118 includes a convex portion 120, a sidewall 122, and a concave portion 124. The convex portion 120 is convex to the surface of the base portion 18 and the concave portion 124 is concave to the surface of the base portion 18. The sidewall 122 is positioned between the convex portion 120 and the concave portion 124.

Figure 6:
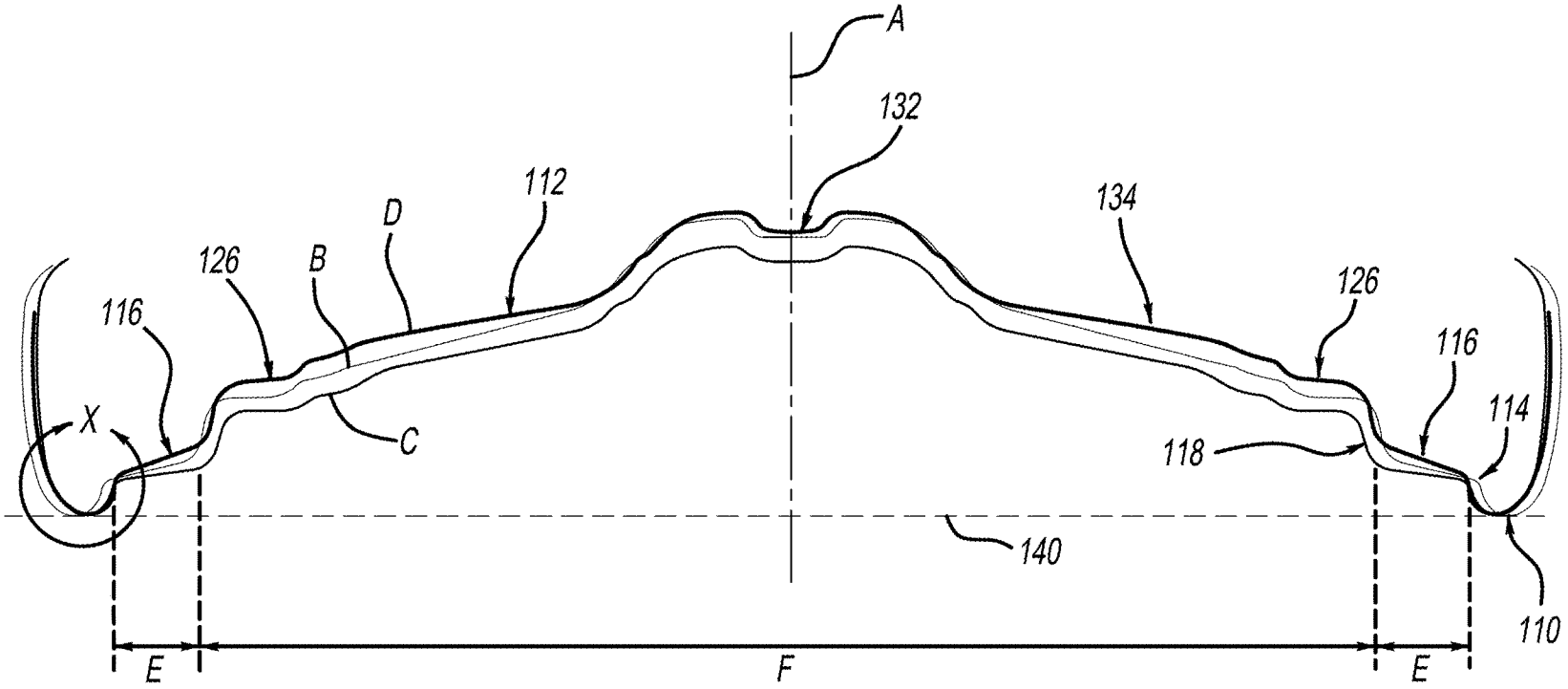
FIG. 6 illustrates the base portion of the container in an as-blown position, an expanded position, and a retracted position.

The base portion 18 further includes a planar portion 126 disposed between the standing ring 110 and the pushup portion 112. The planar portion 126 extends from the concave portion 124 of the step 118 toward the pushup portion 112. The planar portion 126 is substantially parallel to an axis that is perpendicular to the longitudinal axis A of the container 10 or, in other words, a standing surface 140 upon which the container 10 is disposed on (FIG. 6).

The planar portion 126 is segmented by multiple radial grooves 128 defined by the base portion 18. The radial grooves 128 may be disposed equidistant from each other. The radial grooves 128 enhance rigidity and prevent the planar portion 126 from deforming during the hot-fill process as described herein. While the base portion 18 is shown as having five radial grooves 128, the base portion 18 may define any number of radial grooves (e.g., 6).

The pushup portion 112 extends from the planar portion 126 in an upward direction toward the finish 12. That is, a sidewall 130 of the pushup portion 112 is angled upwards and extends toward a center 132 of the container 10 forming a dome-like shape. The center 132 aligns with the longitudinal axis A of the container 10.

The pushup portion 112 includes multiple radial ribs 134 which extend radially between the center 132 and the planar portion 126. The radial ribs 134 strengthen and enhance the rigidity of the pushup portion 112. The radial ribs 134 are offset and alternate from the radial grooves 128 defined along the planar portion 126.

Figure 7:
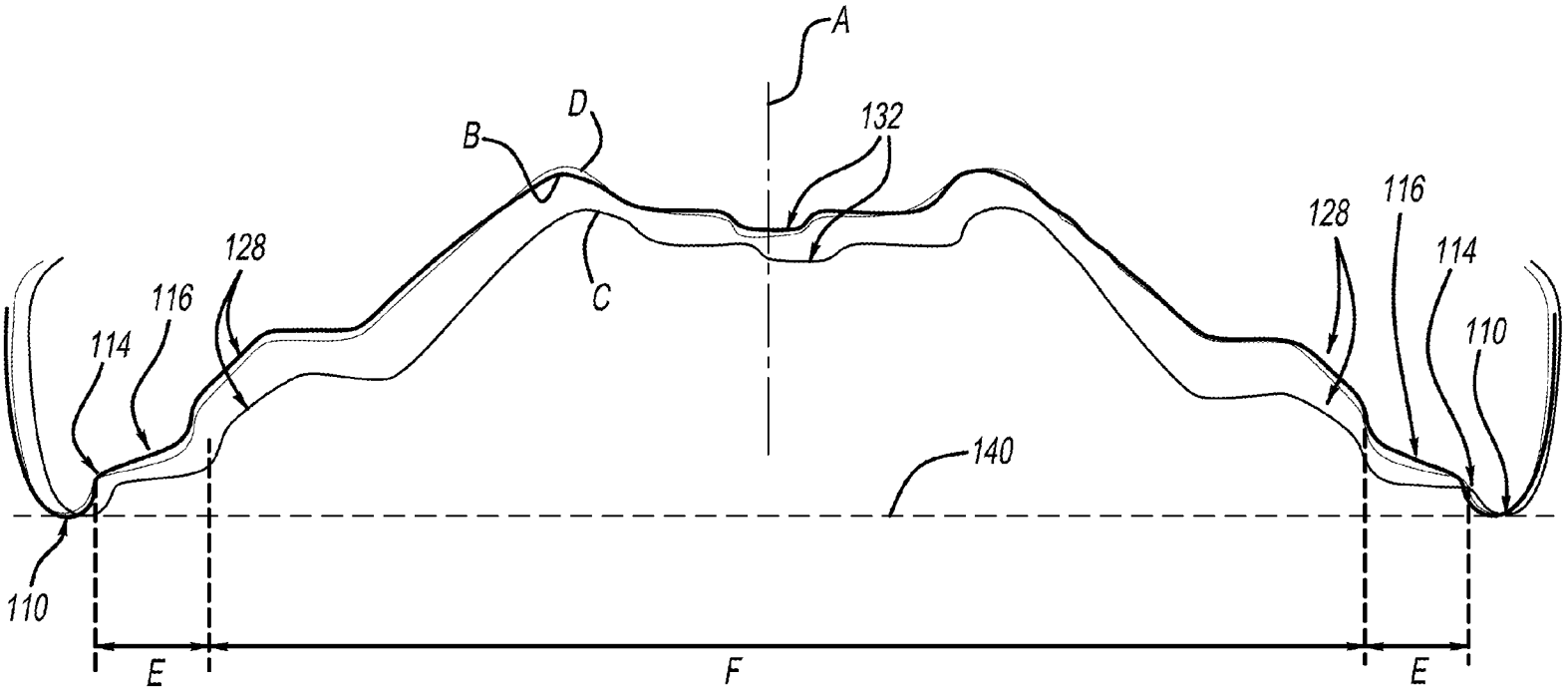
FIG. 7 illustrates the base portion of the container in the as-blown position, the expanded position, and the retracted position.

With additional reference to FIGS. 6 and 7, movement of the base portion 18 in response to temperatures and pressures experienced by the container 10 during hot-filling of the container 10 is now described. For hot-fill bottling applications, bottlers generally fill a container with a liquid or product at an elevated temperature between approximately 195° F. to 205° F. (approximately 90.5° C. to 96° C.) and seal the container with a closure, such as metal lug, before cooling. As the sealed container cools, a vacuum, or negative pressure, forms inside which may cause the container to change shape. For example, 10 to 15 in Hg vacuum can be generated in the container. To activate a tamper evident diaphragm (i.e., a freshness indicator or vacuum safety button) provided on the closure, approximately 8 to 10 in Hg of vacuum may be needed for example. Depending on the diameter of the closure, anywhere from 6 to 22 in Hg may be required to activate the freshness indicator diaphragm. The residual vacuum in the container must always be higher than the vacuum required to activate the diaphragm.

In FIGS. 6 and 7, the base portion 18 is illustrated in an as-blown position at B, an expanded position at C, and a retracted position at D. The base portion 18 includes a pivot area E and a central area F which is surrounded by the pivot area E. The standing ring 110 is provided at an outer diameter of the base portion 18 and surrounds the pivot area E and the central area F. The pivot area E generally extends from the hinge portion 114 to a portion of the planar ring 116 that is connected to the convex portion 120. The central area F generally extends through the longitudinal axis A and includes the step 118, the planar portion 126, the radial grooves 128, and the pushup portion 112. The pivot area E which includes the hinge portion 114 and the planar ring 116, moves the central area F as one uniform piece along the longitudinal axis A as described herein.

FIGS. 1-5 show the container 10 in an as-blown state which is approximately 72 hours after being formed and having been stored at normal condition, such as at room temperature. In the as-blown state, the container 10 is empty and the base portion 18 is in the as-blown position B. The standing ring 110 supports the container 10 in an upright position on the standing surface 140.

Figure 9:
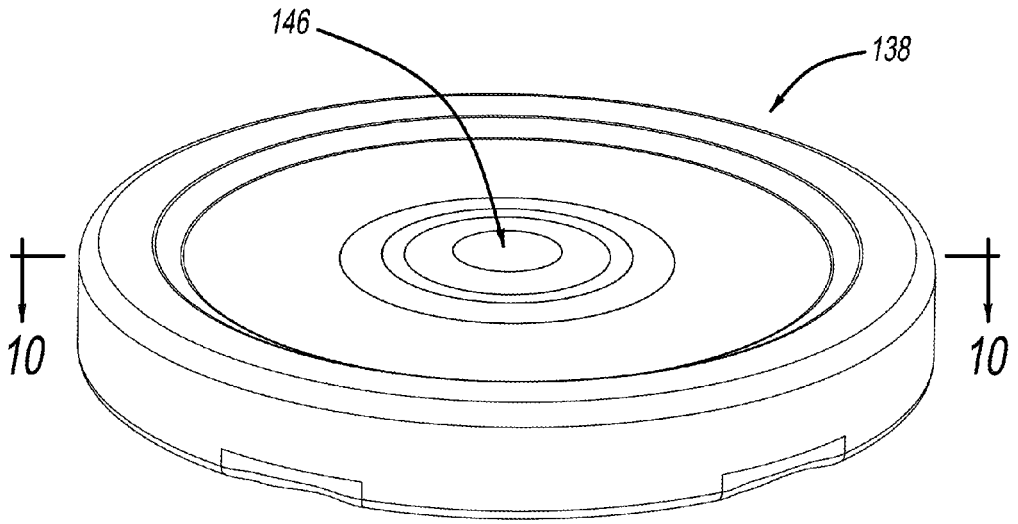
FIG. 9 is a perspective view of a closure.
Figure 10:
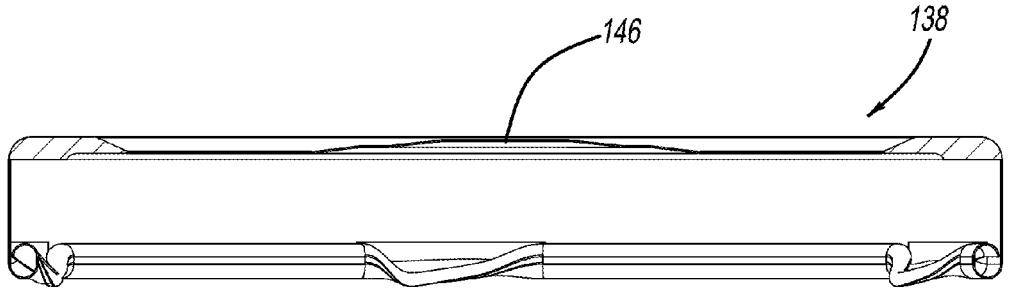
FIG. 10 is a cross-sectional view of the closure taken along line 10-10 of FIG. 9.
Figure 11:
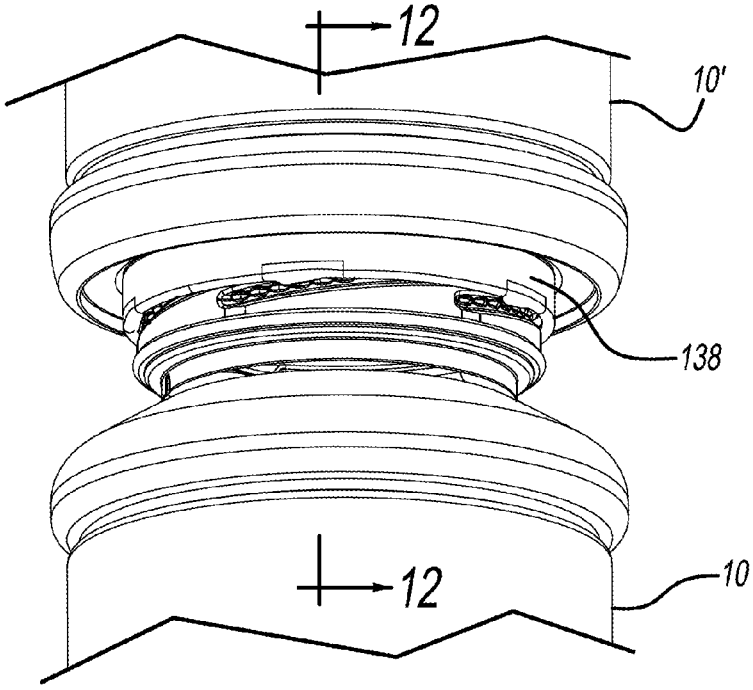
FIG. 11 is a perspective view illustrating the container of FIG. 1 with another container stacked thereon.

During a hot-fill process, the container 10 receives the hot product via the opening 30 and stored in the chamber 42. The container 10 is then capped with a closure 138. FIGS. 9 and 10 show an example of the closure 138. The closure 138 is attached at the finish 12, as shown in FIGS. 11 and 12.

Figure 8:
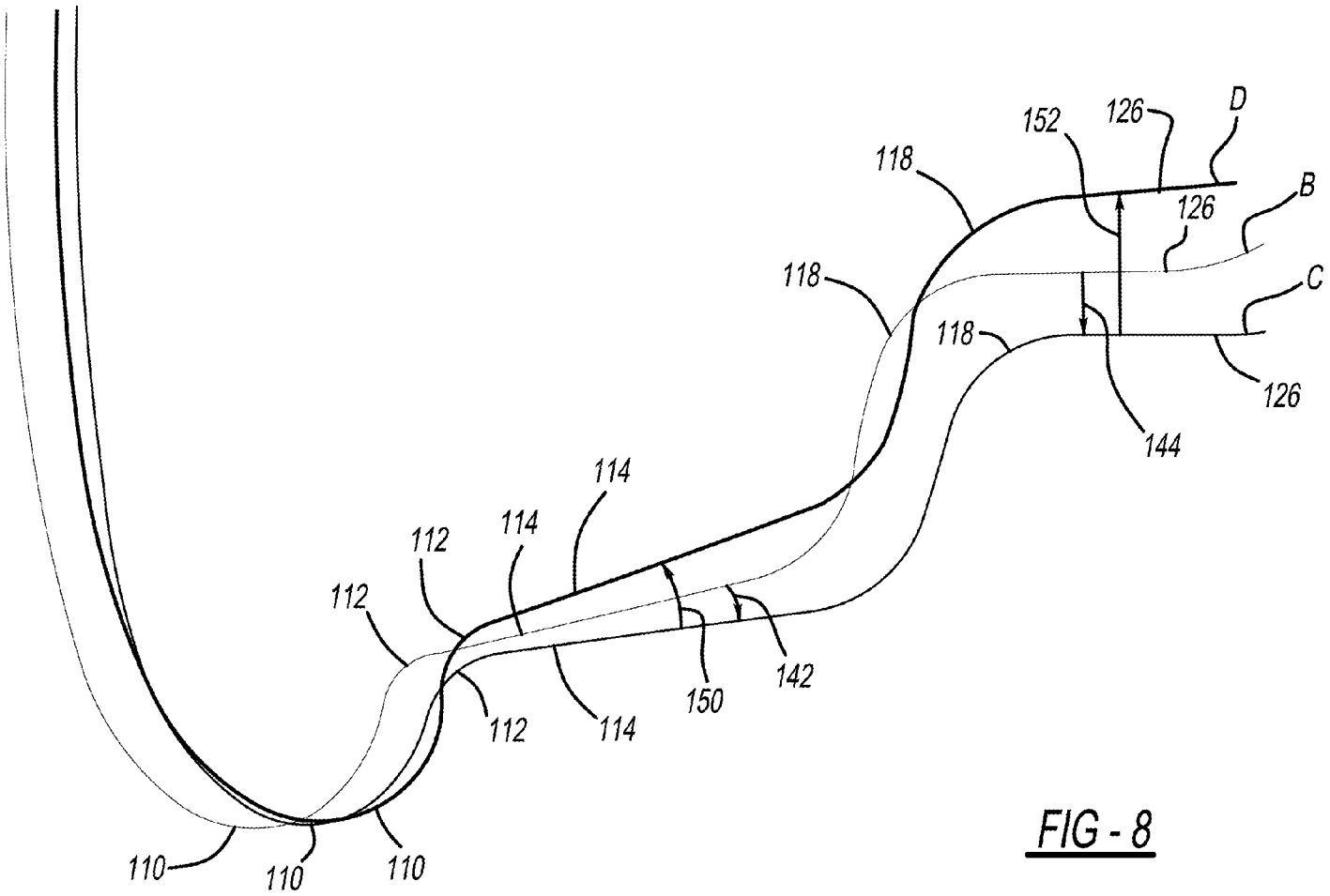
FIG. 8 is an exploded view of the base portion illustrated in FIG. 6.

Prior to the product cooling, the container 10 experiences an increase in pressure due to the expansion in headspace. The increase in pressure expands the base portion 18 to the expanded position C. As illustrated in FIGS. 6 and 7, from the as-blown position B to the expanded position C, the pivot area E flexes to move the central area F as one uniform section along the longitudinal A. That is, as shown in FIG. 8, the hinge portion 114 flexes downward which pivots the planar ring 116 down as indicated by arrow 142. In response to the flexing action of the hinge portion 114 and the planar ring 116, the planar portion 126 and the pushup portion 112 shift down in a direction 144 which is parallel with the longitudinal axis A.

As the base portion 18 moves from the as-blown position B to the expanded position C, the planar portion 126 generally remains flat and parallel to the standing surface 140. More particularly, the radial grooves 128 absorb the pressure and shifts downward, thereby preventing the planar portion 126 from deforming. The radial grooves 128 move more along the longitudinal axis A than the planar portion 126 (FIGS. 6 and 7). In addition, the pushup portion 112, which includes the radial ribs 134, and the planar portion 128 support the base portion 18 to prevent roll out and deformation of the pivot area E.

Figure 12:
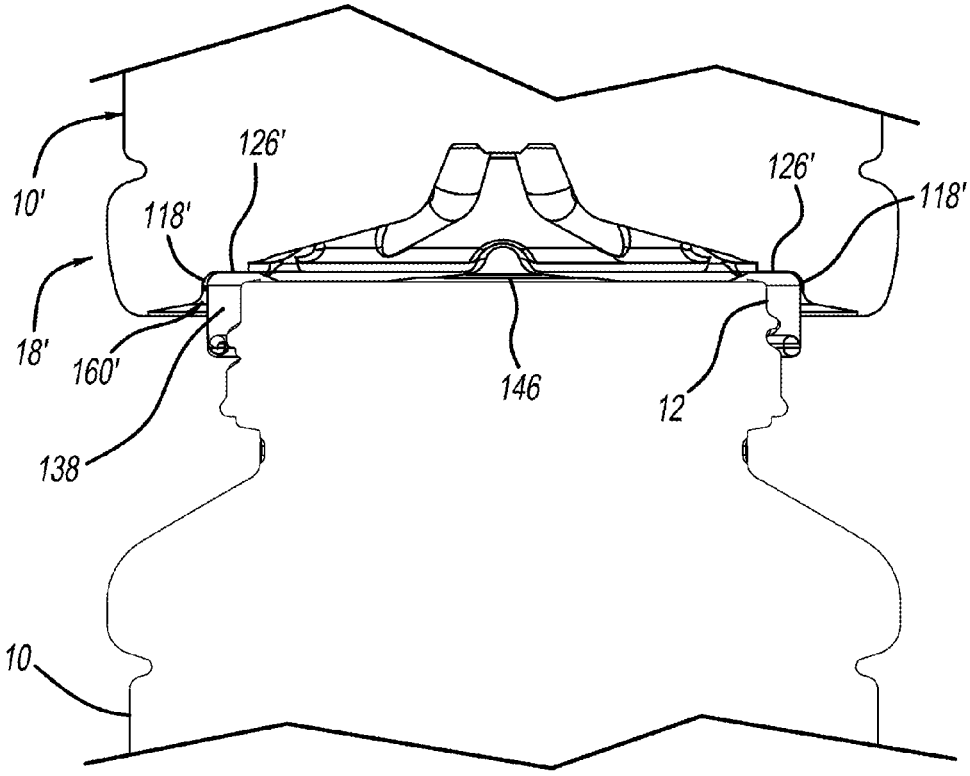
FIG. 12 is a cross-sectional view taken along line 12-12 of FIG. 11.

As the product cools, a vacuum is generated within the container 10 which activates a tamper evident diaphragm 146 of the closure 138 (FIGS. 9, 10, and 12). The base portion 18 retracts and moves from the expanded position C to the retracted position D (FIGS. 6 and 7). As shown in FIG. 8, the hinge portion 114 flexes upward which pivots the planar ring 116 up as indicated by arrow 150. In response to the flexing action of the hinge portion 114 and the planar ring 116, the planar portion 126 and the pushup portion 112 shift up in a direction 152 which is parallel with the longitudinal axis A.

In the retracted position D, the radial grooves 128 retract and move to a position substantially close to the as-blown position B (FIG. 7). Similarly, with regard to the pushup portion 112, portions of the sidewall 130 that are outside of the radial ribs 134 move to a position substantially close to the as-blown position B. The planar portion 126 and the radial ribs 134 are generally evenly distributed about the as-blown position B in the retracted position D and the expanded position C. The planar portion 126 and the radial ribs 134 move less than the radial grooves 128 and portions of the sidewall 130 outside of the radial ribs 134 (FIG. 6).

While the base portion 18 does move due to the negative pressure created as the product cools, the base portion 18 mitigates the negative pressure such that an adequate amount of negative pressure remains within the container 10 to activate the tamper evident diaphragm 146 (e.g., 10-20 psi of negative pressure). For example, the planar portion 126 and radial ribs 134 structurally support the base portion 18 to minimize movement due to the vacuum and prevent deformation in the pivot area E. The radial grooves 128 move to dissipate the pressure and prevent the planar portion 126 from deforming. Thus, the base portion 18 utilizes the vacuum naturally created as the product cools to activate the tamper evident diaphragm 146.

As the base portion moves from the as-blown position B to the expanded position C and from the expanded position C to the retracted position D, the standing ring 110 maintains contact with the standing surface 140. The standing ring 110 continuously supports the container 10 in the upright position.

With continuing reference to FIG. 4, the base portion 18 includes a cavity 160 for aligning and holding a closure of another container stacked under the container. The cavity 160 is generally defined by the step 118 and the planar portion 126.

More particularly, with reference to FIGS. 11 and 12, the container 10 is illustrated with a second container 10' stacked thereon. The container 10" is similar to the container 10, and thus features of the container 10" that are in common with the container 10 are illustrated with the same reference numerals, but include the prime (') symbol. The step 118' and the planar portion 126' of the container 10" define the cavity 160' for aligning with the closure 138 of the container 10. The planar portion 126' abuts with the closure 138 of the container 10. Accordingly, the closure 138 of container 10 can be received within the base portion 18' such that the step 118' and the planar portion 126" of the container 10" surround the closure 138. The cavity 160 securely receives the closure 138 within the base portion 18" and prevents the container 10' from sliding off of the closure 138.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

What is claimed is:

1. A container comprising:

a finish defining an opening;

a shoulder portion extending from the finish;

a body extending from the shoulder portion in a direction parallel with a longitudinal axis and defining a chamber; and a base portion extending at an end of the body opposite to the shoulder portion and being moveable from an as-blown position to an expanded position, and from the expanded position to a retracted position, the base portion including a planar ring, a planar portion, and a pushup portion;

wherein the planar ring is pivotable and moves the planar portion and the pushup portion along the longitudinal axis when the base portion moves from the as-blown position to the expanded position and from the expanded position to the retracted position; and wherein the planar portion is substantially parallel to a plane extending along an axis perpendicular to the longitudinal axis in the as-blown position, the expanded position, and the retracted position.

2. The container of claim 1 wherein the base portion defines a plurality of radial grooves along the planar portion.

3. The container of claim 2 wherein the radial groove moves more than the planar portion along the longitudinal axis when the base portion moves from the as-blown position to the expanded position and when the base portion moves from the expanded position to the retracted position.

4. The container of claim 1 wherein the base portion includes a hinge portion that is concave to a surface of the base portion, the planar ring extends from the hinge portion, and the hinge portion flexes such that the planar ring pivots when the base portion moves from the as-blown position to the expanded position, and from the expanded position to the retracted position.

5. The container of claim 1 wherein the base portion includes a standing ring disposed along an outside diameter of the base portion, and the standing ring does not move along the longitudinal axis when the base portion moves from the as-blown position to the expanded position, and from the expanded position to the retracted position.

6. The container of claim 1 wherein the pushup portion includes a plurality of ribs radially extending from the longitudinal axis, and an area of the pushup portion not having the ribs moves more than the ribs when the base portion moves from the as-blown position to the expanded position, and from the expanded position to the retracted position.

7. The container of claim 1 wherein the finish is a blow-trim or injection threaded finish.

8. The container of claim 1 is made of polyethylene terephthalate.

9. The container of claim 1 wherein the finish includes multiple internal threads that extend along an inner surface of the finish.

10. The container of claim 1 is made of a multi-layer material.

11. A container comprising:

a finish defining an opening;

a shoulder portion extending from the finish;

a body extending from the shoulder portion in a direction parallel with a longitudinal axis and defining a chamber; and a base portion extending at an end of the body opposite to the shoulder portion and being moveable from an as-blown position to an expanded position, and from the expanded position to a retracted position, and the base portion including a planar ring, a planar portion, and a pushup portion; and a closure disposed on the finish and closing the opening, wherein the closure includes a tamper evident diaphragm that is activated in the retracted position;

wherein the base portion defines a plurality of radial grooves along the planar portion and includes a plurality of ribs extending radially in the pushup portion, the ribs are disposed offset and alternative of the radial grooves, and the planar ring is pivotable and moves the planar portion and the pushup portion as a uniform section in a first direction along the longitudinal axis as the base portion moves from the as-blown position to the expanded position and in a second direction opposite the first direction as the base portion moves from the expanded position to the retracted position;

wherein the planar portion is substantially parallel to a plane extending along an axis perpendicular to the longitudinal axis in the as-blown position, the expanded position, and the retracted position; and wherein the base portion includes: a hinge portion that is concave to a surface of the base portion, the planar ring extends from the hinge portion, and the hinge portion flexes such that the planar ring pivots as the base portion moves from the as-blown position to the expanded position, and from the expanded position to the retracted position, and a standing ring disposed along an outside diameter of the base portion, and the standing ring does not move along the longitudinal axis as the base portion moves from the as-blown position to the expanded position, and from the expanded position to the retracted position.

12. The container of claim 11 wherein the radial grooves are positioned lower in the expanded position than in the as-blown position.

13. The container of claim 11 wherein the radial grooves are positioned substantially at a same position in the as-blown position and the retracted position.

14. The container of claim 11 wherein the ribs move less than the radial grooves as the base portion moves from the as-blown position to the expanded position and from the expanded position to the retracted position.

15. The container of claim 11 wherein the finish is a blow-trim or injection threaded finish.

16. The container of claim 11 is made of polyethylene terephthalate.

17. The container of claim 11 wherein the finish includes multiple internal threads that extend along an inner surface of the finish.

18. The container of claim 11 is made of a multi-layer material.

* * * * *